United States Patent [19]

Hohwart

[11] 4,248,419

[45] Feb. 3, 1981

[54] SWIMMING APPARATUS

[76] Inventor: George Hohwart, 2765 Eager Rd., Howell, Mich. 48843

[21] Appl. No.: 40,232

[22] Filed: May 18, 1979

[51] Int. Cl.[3] ..... A63B 31/00

[52] U.S. Cl. ..... 272/71; 272/142; 272/DIG. 4

[58] Field of Search ..... 272/71, 142, 136, 125, 272/126; 35/29 B; 9/310 J

[56] References Cited

U.S. PATENT DOCUMENTS

| | | | |
|---|---|---|---|
| 174,669 | 3/1876 | Ford | 272/136 UX |
| 3,982,756 | 9/1976 | Hersey et al. | 272/132 X |
| 4,109,905 | 8/1978 | Meier | 272/71 |

OTHER PUBLICATIONS

Exerswim ® Hans Sickinger Co. 576 So. Telegraph Rd., Pontiac, Mich., 48053, Copyright Hans Sickinger Co.-1976.

*Primary Examiner*—Richard C. Pinkham
*Assistant Examiner*—Arnold W. Kramer
*Attorney, Agent, or Firm*—Harness, Dickey & Pierce

[57] ABSTRACT

A swimming apparatus wherein an endless, elongate, rope-like belt is looped once around the waist of the swimmer and over a suitable guide which permits the belt to slide back and forth as the swimmer rolls alternately one way and then the other in performing the customary swimming motions. A ring receives the loop at the swimmer's waist and keeps it from slipping along the swimmer's body without interfering with the swimming action. A stationary support at the water's edge carries the guide and holds it yieldingly retracted to prevent the belt from tangling in the swimmer's legs.

17 Claims, 4 Drawing Figures

SWIMMING APPARATUS

BACKGROUND OF THE INVENTION

The invention is concerned with a swimming apparatus that is adapted to be worn by a swimmer in a pool and that serves to hold the swimmer yieldingly in the pool without interfering with his freedom of movement.

The swimming apparatus herein disclosed is an improvement in the apparatuses disclosed in U.S. Pat. Nos. 3,512,416 and 4,095,657. These two patents cover prior inventions of the present applicant. They and the prior art cited therein represent the most pertinent known prior art. Both of the patented apparatuses referred to specifically above are similarly intended to be used by a swimmer in a swimming pool and they are intended to serve the same general purpose as the apparatus of this invention. However, the patented apparatuses are mechanically more complicated and cumbersome than the apparatus of this invention and they are more expensive to manufacture. Contrariwise, the swimming apparatus of this invention is mechanically simpler, and it can be manufactured relatively inexpensively. Its simplicity makes the swimming apparatus of this invention less cumbersome. It interferes less with the swimming motions. It leaves the swimmer free to use any desired swimming stroke and to dive or otherwise move in the water without interference from the apparatus which otherwise restrains his movements.

SUMMARY OF THE INVENTION

As suggested, the swimming apparatus of this invention consists essentially of an elongate, endless, rope-like belt that is adapted to be wrapped at least once about the swimmer's waist and looped over a pulley or other suitable guide mounted preferably at the edge of the pool. The portions of the belt extending fom the waist loop pass oppositely through a ring that also surrounds the waist loop. This arrangement of ring and belt portions holds the belt snugly at the swimmer's waist and prevents it from sliding down the swimmer's body in use. At the same time, the ring receives the portions of the belt extending therethrough relatively loosely so that the confined portions of the belt are free to move freely through the ring as the swimmer rolls or turns while swimming. The guide means that holds the portion of the belt remote from the swimmer is carried by a suitable support mounted preferably at the edge of the pool. The support holds the guide sufficiently elevated so that the portions of the belt extending from the swimmer are entirely or substantially entirely above the surface of the water so as not to tangle in the swimmer's legs. In addition, the support is spring loaded to hold the guide yieldingly retracted. This not only assists in holding the belt above the surface of the water but it also yieldingly resists forward movement of the swimmer and enables him to swim as hard as he likes in a natural way without undue strain.

DESCRIPTION OF THE DRAWING

In the drawing wherein for the purpose of illustration is shown a preferred embodiment of the invention.

DESCRIPTION OF THE PREFERRED EMBODIMENT

Figures 1, 2, 3, 4:
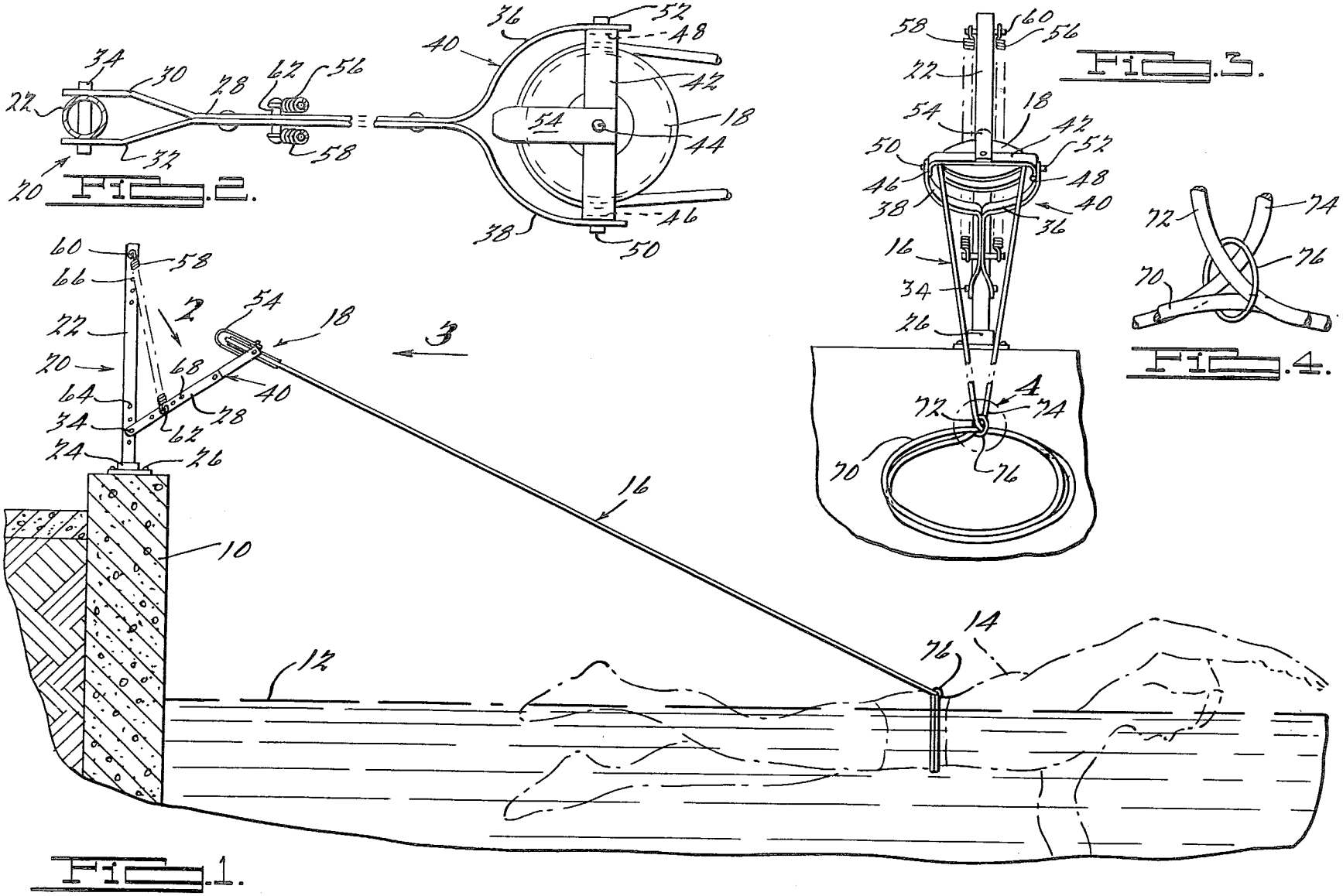
FIG. 1 is a side elevational view showing the swimming apparatus of this invention in use.
FIG. 2 is an enlarged, fragmentary view looking in the direction of the arrow 2 in FIG. 1.
FIG. 3 is an enlarged, fragmentary view looking in the direction of the arrow 3 in FIG. 1.
FIG. 4 is an enlarged view of the portion of FIG. 3 enclosed in the circle 4.

In the drawing, the numeral 10 designates a swimming pool which may be of any desired or conventional type and is here shown by way of illustration as having a vertical perimeter wall of concrete or the like. The numeral 12 designates the level of water in the pool 10; and, in FIG. 1, a swimmer 14 is shown in swimming position in the water and wearing the swimming apparatus of this invention.

More particularly, the swimming apparatus referred to comprises an endless rope-like belt 16 which extends from the swimmer 14 to a guide 18, here shown in the form of a pulley. The guide 18 in turn is carried by a suitable support 20 which surmounts and is fixed to the vertical wall of the pool 10.

The support 20 here shown comprises an upright tubular member 22 having a base 24 which rests directly on the wall of the pool 10 and is fastened thereto by suitable anchor bolts 26. A cantilever arm 28 is formed at one end thereof with bifurcations 30 and 32 (FIG. 2) that embrace and are fastened by a pivot 34 to the lower portion of the upright member 22. At its opposite end, the cantilever arm 28 is similarly formed with bifurcations 36 and 38 defining a clevis 40 which is spanned by a U-shaped bracket 42 to which the pulley 18 is pivotally attached at 44. As perhaps best shown in FIG. 3, the end flanges 46 and 48 of the bracket 42 fit snugly between the clevis arms 36 and 38. Aligned pivots 50 and 52 interconnect the end flanges 46 and 48 to respective clevis arms 36 and 38 so that the bracket 42 and the pulley 18 carried thereby are free to turn or rock on the pivots 50 and 52. A U-shaped bracket member 54 extends at right angles to the bracket 42 and fits over and loosely receives the pulley 18. The ends of the U-shaped bracket member 54 are connected to the pivot 44 at opposite sides of the pulley 18 to attach the latter securely to the bracket 42 in such a way that the pulley is free to rotate on the pivot 44 and at the same time to rock back and forth on the pivots 50 and 52.

A pair of tension springs 56 and 58 attached to the upper terminal portion of the upright tubular support member 22 by a pin 60 and to the cantilever arm 28 intermediate its ends by a pin 62 hold the cantilever arm normally raised, as shown in FIG. 1. The lower portion of the support member 22 is formed with a series of spaced holes 64 each of which is adapted to receive the pivot 34 to permit vertical adjustment of the cantilever arm 28 on the support, and the upper portion of the support member 22 also is provided with a plurality of spaced holes 66, any one of which will receive the pin 60. Similarly, the cantilever arm 28 is provided with a plurality of spaced holes 68 all capable of accommodating the pin 62 so as to permit the springs 56 and 58 to be selectively adjusted and positioned with respect to the support 22 and the arm 28. By adjusting the ends of the springs 56 and 58 in the manner described, the initial angular position of the cantilever arm 28 can be selectively varied and the resistance provided by the springs to movement of the arm on its mounting pivot 34 can be regulated.

The portion of the belt 16 remote from the swimmer 14 extends around the guide pulley 18 and is retained by the peripheral groove in the pulley. At its opposite end, the belt 16 is fashioned into a loop 70 which is adapted to extend around the swimmer's waist, as shown in FIG. 1, and the portions 72 and 74 of the belt extending from the loop 70 pass in opposite directions through a ring 76 that also surrounds the loop 70. As shown in FIG. 4, the ring 76 loosely confines the portion of the loop 70 and the portions 72 and 74 of the belt so as to gather them at the swimmer's waist but in a manner that permits the belt to thread easily back and forth therethrough. In use, the ring 76 positions itself properly automatically to accommodate whatever swimming position the swimmer chooses. For example, in the face down position shown in the drawing, the ring 76 positions itself at the swimmer's back and if the swimmer rolls to a face up position, the ring will position itself automatically at the swimmer's front.

MODE OF OPERATION AND USE

It will be observed that the support 20 is adapted to be permanently mounted on the edge of the pool 10 or in any other convenient location that will properly serve the swimmer 14. The belt 16 normally is left attached to the pulley guide 18. In practice, the swimmer 14 can step into the belt loop 70 before he enters the pool or, if the pool is sufficiently shallow, he can step into the loop after entering the pool. Either way, he pulls the belt 16 snugly around his waist before starting to swim. In this connection, it will be readily apparent that the loop 70 can be readily expanded or enlarged simply by pulling the belt portions 72 and 74 through the ring 76 so as to enable the swimmer 14 to step easily into or out of the loop and it can be just as easily contracted to fit snugly around the swimmer's waist. When the belt portions 72 and 74 are pulled, the loop 70 is tightened automatically around the swimmer's waist regardless of size or the age of the swimmer. In any event, once the belt 16 is pulled snugly about his waist and the swimmer 14 is in the pool, he can immediately begin swimming. As the swimmer moves forwardly in the water, the belt 16 is pulled taut and the portion thereof between the swimmer and the pulley guide 18 will be entirely or substantially entirely above the surface of the water, as shown in FIG. 1. Forward movement of the swimmer of course is restrained by the belt 16 and the pull exerted by the swimmer on the pulley guide 18 is yieldingly resisted by the springs 56 and 58. The cantilever arm 28 is free to swing back and forth on the pivot 34 against the resilient action of the springs 56 and 58 and, at the same time, the pulley guide 18 is free to rock on the pivots 50 and 52 to accommodate and adjust automatically to the swimmer's motions and to the attitude and position of the swimmer in the water as he rolls first to the right and then to the left in executing the normal swimming motion. As these actions occur, the belt 16 threads first in one direction and then the other around the swimmer's waist, and this slight seesawing action of the belt is readily accommodated by the ring 76 and the pulley guide 18. Of course, the swimmer 14 can if he so desires roll completely over continuously and repeatedly and, when he does this, the belt 16 simply threads in one direction through the ring 76 and around the guide pulley 18 without changing its position on the swimmer or relative to the support 20. The manner in which the belt 16 is confined at the swimmer's waist by the ring 76 prevents the belt from interfering in any way with the motion of the swimmer's arms and the pull exerted by the swimmer is counteracted at all times by the springs 56 and 58 through the cantilever arm 28 to keep the belt 16 sufficiently taut so that it will not tangle in the swimmer's legs.

In connection with the foregoing, it will be readily appreciated that the guide 18 may be either stationary or rotatable as in the case of the pulley here shown by way of example. When the guide 18 is in the form of a pulley, it of course is free to rotate and thus accommodate the slight seesawing action of the belt that occurs in normal swimming. The free turning movement of the pulley permits this action to take place with a minimum resistance. The pulley also offers a means for permanently retaining the belt 16 and for holding it attached to the support 20. However, it is not essential to the invention that the belt 16 be attached to the guide 18 in a manner that prevents its removal. In some instances, the swimmer may even prefer that the belt 16 not be so attached to the guide 18. The guide 18 may have any form that provides a peripheral surface, and preferably a grooved surface that faces away from the swimmer, and that is essentially smooth so as to permit the belt 16 to slide freely back and forth in use. Under these circumstances, the swimmer 14 simply steps into the loop 70 and drops the opposite end loop portion of the belt over the guide either prior to or after entering the pool.

Although the invention has been described with respect to certain embodiments, it is understood that numerous modifications and changes may occur to those skilled in the art and that any such modifications and changes are included within the scope of the invention as defined by the following claims.

I claim:

1. In a swimming apparatus, an endless rope-like belt means adapted to cooperate with an associated guide means and having at least two loops coiled in a section thereof for placement around the waist of a swimmer in snug fitting relation thereto; and holding means defining an aperture for receiving and loosely fitting the three portions of said section making up said at least two coiled loops, said holding means being free to move bodily with the swimmer in all directions relative to said guide means, whereby said swimmer has relatively unrestricted freedom of movement during swimming but is restrained in his forward motion by said belt and guide means.

2. A swimming apparatus comprising guide means;

support means carrying said guide means adapted for mounting adjacent to a swimming pool;

an endless rope-like belt means coiled into three loops; and a ring having all three loops of said belt means extending therethrough and having a loose running fit therewith, with one of said loops being cooperable with said guide means and the other two of said loops adapted to be placed around the waist of a swimmer.

3. The swimming apparatus of claim 2 wherein said guide means has an exposed peripheral portion defining a belt-engaging surface facing away from the swimmer and adapted to slidably receive and to retain said one loop of said belt means.

4. The swimming apparatus of claim 2 wherein said guide means is in the form of a rotatable pulley carried by said support means.

5. The swimming apparatus of claim 2, said support means including a support having a clevis portion, and wherein said guide means includes a rotatable pulley disposed in and connected for pivotal movement to the clevis portion of said support.

6. The swimming apparatus of claim 2, said support means including a cantilever arm carrying said guide means and mounting means for said cantilever arm, means interconnecting said cantilever arm and said mounting means permitting limited pivotal movement of said arm in use, resilient means yieldably resisting such movement, and means for selectively varying the resistance provided by said resilient means.

7. The swimming apparatus of claim 2, said support means including a cantilever arm carrying said guide means and mounting means for said arm, and means for adjusting said cantilever arm vertically on said mounting means to vary the height of said arm and of said guide means in use.

8. The swimming apparatus of claim 2, said support means including a cantilever arm carrying said guide means and mounting means pivotally supporting said cantilever arm, resilient means coactive with said cantilever arm and operative to yieldingly resist movement of the latter in the direction of said swimmer, and means for selectively varying the resistance provided by said resilient means.

9. The swimming apparatus of claim 8 wherein said mounting means is in the form of an upright support, and wherein said resilient means is in the form of tension spring means interconnecting said support and said cantilever arm.

10. The swimming apparatus of claim 9 including means for adjustably mounting said cantilever arm on said support, and means for adjusting the point of attachment of said spring means to at least one of said support and said cantilever arm.

11. The swimming apparatus of claim 10 wherein said spring means is adjustably connected to both said support and said cantilever arm to permit the initial angular position of said arm with respect to said support to be selectively determined and to regulate the action of said spring in resisting pull exerted on said cantilever arm in use by said swimmer through said guide and said belt means.

12. The swimming apparatus of claim 2 including means permitting limited movement of said guide means toward and from said swimmer.

13. The swimming apparatus of claim 12 including means for yieldingly resisting movement of said guide means toward said swimmer.

14. The swimming apparatus of claim 13 wherein said last mentioned means is further operative to hold said guide means normally retracted from said swimmer.

15. The swimming apparatus of claim 2 including means forming a part of said support means permitting pivotal movement of said guide means about at least two axes extending substantially at right angles to each other.

16. The swimming apparatus of claim 2 wherein said support means includes first means permitting pivotal movement of said guide means about at least two axes extending substantially at right angles to each other, and second means permitting limited movement of said guide means to and from the swimmer, said second means adapted to yieldingly resist movement of said guide means in the direction of said swimmer.

17. The swimming apparatus of claim 2 wherein said support means includes first means permitting pivotal movement of said guide means about at least two axes extending substantially at right angles to each other, second means permitting limited movement of said guide means to and from the swimmer, said second means adapted to yieldingly resist movement of said guide means in the direction of said swimmer, and third means for regulating the degree of yielding resistance afforded by said second means to movement of said guide means toward the swimmer.

* * * * *